US006341922B1

(12) United States Patent
Jaecklin

(10) Patent No.: US 6,341,922 B1
(45) Date of Patent: Jan. 29, 2002

(54) CELLULAR CONSTRUCTION, IN PARTICULAR SUPPORTING OR SOUND INSULATING CONSTRUCTION CAPABLE OF BEING GREENED, AND PROCESS FOR PRODUCING THE SAME

(75) Inventor: Felix Paul Jaecklin, Ennetbaden (CH)

(73) Assignee: Felix P. Jaecklin (CH)

( * ) Notice: Subject to any disclaimer, the term of this patent is extended or adjusted under 35 U.S.C. 154(b) by 0 days.

(21) Appl. No.: 09/284,638

(22) PCT Filed: Oct. 20, 1997

(86) PCT No.: PCT/EP97/05772

§ 371 Date: Jun. 17, 1999

§ 102(e) Date: Jun. 17, 1999

(87) PCT Pub. No.: WO98/17866

PCT Pub. Date: Apr. 30, 1998

(51) Int. Cl.[7] ..... E02D 5/00
(52) U.S. Cl. ..... 405/280; 405/285
(58) Field of Search ..... 405/262, 258, 405/284, 286, 285, 280

(56) References Cited

U.S. PATENT DOCUMENTS 4,572,705 A * 2/1986 Vignon et al. ..... 405/16
5,024,036 A * 6/1991 Johnson ..... 405/262 X
5,156,496 A * 10/1992 Vidal et al. ..... 405/262
5,531,547 A * 7/1996 Shimada ..... 405/262
5,658,096 A * 8/1997 Von Kanel ..... 405/258
5,947,643 A * 9/1999 Anderson et al. ..... 405/262

FOREIGN PATENT DOCUMENTS

WO 86/04103 * 7/1986

* cited by examiner

*Primary Examiner*—Frank S. Tsay
(74) *Attorney, Agent, or Firm*—Lalos & Keegan

(57) ABSTRACT

A cellular structure, in particular a supporting or sound insulation structure plantable with greenery, one with earth, rock, or bulk material filling (Ed), arranged in particular as cells (Z) in layers, the cells being bounded at least in part by flat flexible, liquid-permeable, and corrosion-resistant material (F), in particular material in the form of netting or a grating, and having at least one dimensionally stable frontal element (FG) also in the form of netting or a grating which is connected to tension bracing (ZA) extending into the cell filling and to support bracing (ZV) ensuring the assigned frontal surface inclination and frontal surface position of the structure, the support bracing (ZV) for the individual front elements having at least one elongated bracing element (AS) which on one side is connected to a front element (FG) and on the other extends into the area of the filler.

29 Claims, 6 Drawing Sheets

CELLULAR CONSTRUCTION, IN PARTICULAR SUPPORTING OR SOUND INSULATING CONSTRUCTION CAPABLE OF BEING GREENED, AND PROCESS FOR PRODUCING THE SAME

DISTINGUISHING FEATURES OF THE INVENTION

In every area of a support bracing (ZV) between the point of connection (K1) of the tension bracing flat material (F) to the support bracing (ZV) on one side and the point of connection (K2) to the front element (FG) on the other side, tension force transmission is provided more or less only by the flat material (F).

FIELD OF INVENTION

The invention relates to a cellular structure, in particular a supporting or sound insulation structure plantable with greenery, one filled with earth, rock, or bulk material, arranged in particular as cells in layers, the cells being bounded at least in part by flat flexible, liquid-permeable, and corrosion-resistant material, in particular material in the form of netting or grating, and having at least one dimensionally stable, frontal element in the form of netting or a grating which is connected to tension bracing extending into the cell filling and to support bracing ensuring the assigned frontal surface inclination and frontal surface position of the structure, the support bracing having at least one elongated bracing element which on one side is connected to a frontal element and on the other extends into the area of the filler material. The subject of the invention also includes prefabricated components or subassemblies and a process for manufacturing structures or components or subassemblies.

BACKGROUND OF INVENTION

A structure of the type described by way of introduction is known from EP-A-0574233 A1. In this instance the support bracing consists as installed of closed triangular frameworks, each of the rod elements making up this framework being mounted on the bottom of the cell and its front end being connected to the bottom edge of a corresponding frontal element and its rear end to the flexible flat material of the tension bracing. The result is that the load on the front section of this flat material is relieved by coupling in parallel of the frame rod of the tension bracing on the bottom, which is more rigid under tension and can participate only to a lesser extent in the transmission of tensile force. Another consequence is concentration of tensile force transmission on the bottom edge of the front element on the point of connection with the triangular frame present there. This means increased local stress and the possibility of undesirable deformation of the material of the front elements, which material is generally latticed and consequently less resistant to bending.

OBJECT OF THE INVENTION

The object of the invention is accordingly creation of a cellular structure of the type indicated in the foregoing which is characterized by improved strength and stability of shape, as well as by reduced material and manufacturing costs. Attainment of the goal claimed for the invention is determined by the totality of the features presenting in claim 1. These features allow largely uniform load distribution in the area of the bottom edge of the front element, both inside the flat material of the tension bracing itself and in the material of the front element, it being possible to optimize the tensile strength of this flat material by suitable design, in particular that of a grating or netting, adapted to the particular load application relationships and by proper choice of materials.

DRAWINGS OF THE INVENTION

FIG. 5 shows a

Figure 1:
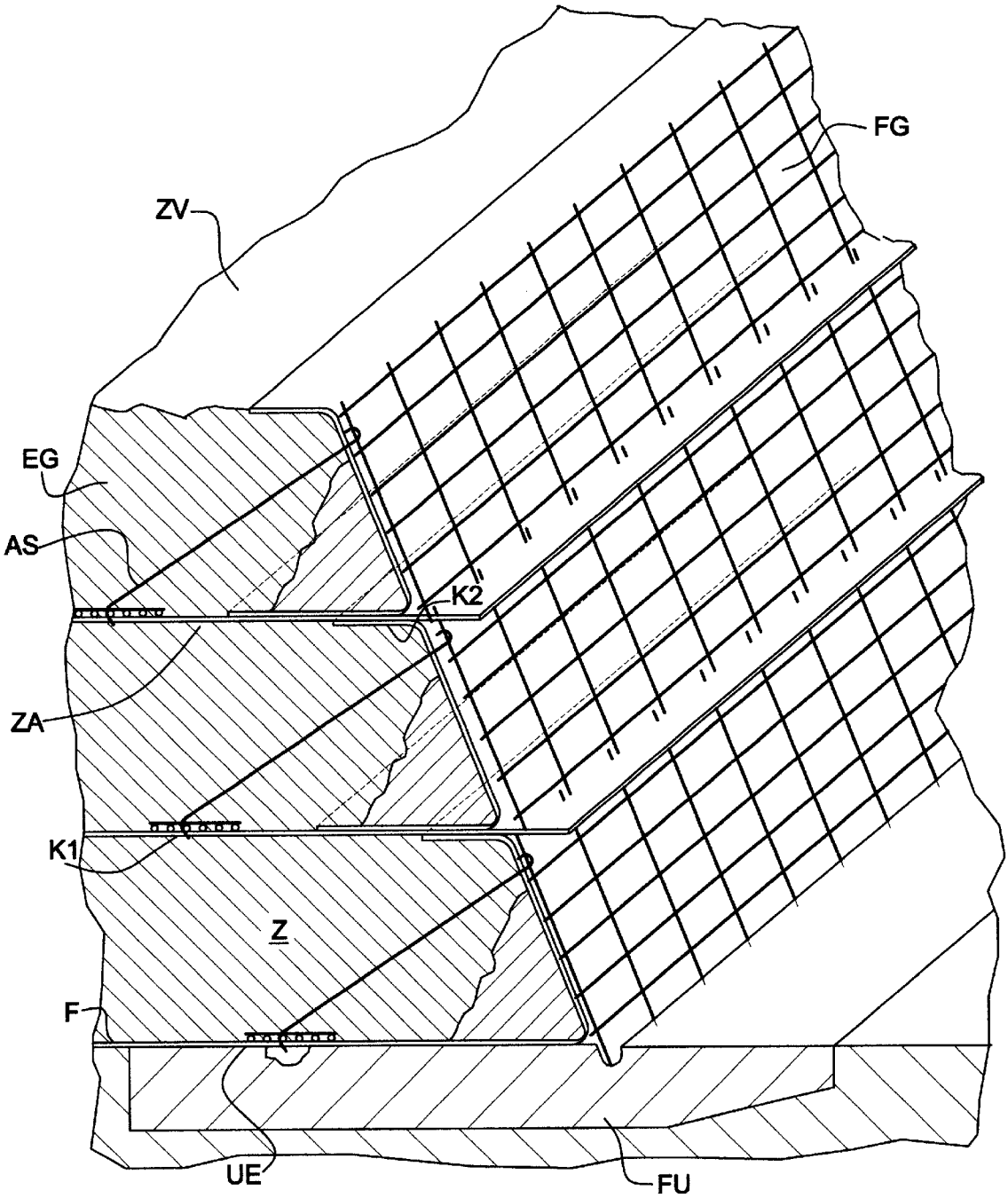
FIG. 1 shows a perspective partial view of a bracing insulation structure.

An essential and especially advantageous development of this solution is determined by the features of claim 2. They permit in particular sufficiently uniform support and load distribution even in the central and upper areas of the front element elevation, in which connection of additional tension bracing flat material is generally undesirable for reasons of cost. Support bracing such as this with rod-shaped bracing elements on the rear end connected only to flat tension bracing material situated on the bottom of the cell introduces the supporting forces applied to the connection with the front element into the tension bracing where the flat material of the latter has a strong tensional connection with the load-applying backfill, so that load concentrations may be kept small in this instance as well. Structural features such as these claimed for the invention are also characterized by simplicity of design and favorable material and manufacturing costs.

An especially important and advantageous development of the invention is determined by the features described in claims 18 and 19. They result in a structure of the connection to tension bracing which is advantageously simple and is cost effective as well as optimum from the viewpoint of load distribution.

Other features and advantages of the invention are explained in what follows with reference to the embodiments illustrated diagrammatically in the drawings.

FIG. 1 shows a perspective partial view of a bracing or sound insulation structure designed as a cellular structure filled with earth, rock, or bulk material which is arranged in cells Z. The cells are bounded more or less by flexible and liquid-permeable flat netting or latticed material F of tension bracing ZA and by a dimensionally relatively stable latticed front element FG or several such elements. This flat material is connected in area K2 to the bottom edge of the front element and extends along the bottom of the cell rearward into filler material EG. In addition, a support bracing ZV ensuring the assigned frontal inclination and frontal position of the front elements is provided; this support bracing has for the individual front elements at least one elongated bracing element AS which on one side is connected to a front element FG and on the other extends into the area of the filler.

In the example illustrated the bracing elements are in the form of individual rods with means on the end for connection to the front element (FG) or to the tension bracing (ZA). They have at least one section in the form of a hook or an eye which may be suspended by positive locking in a latticed front element or a force transmission element, preferably on both end sections. Two suspendable hook-shaped or eye-shaped sections twisted around a rod axis to be at an angle of at least approximately 90° relative to each other are especially advantageous.

A significant development of the invention provides that at least one transmission element (UE) with a plurality of projections and recesses or indentations or gaps and prominences facing the flat material for completing positive locking is provided for a positive locking connection between a rod-shaped element (AS, AS1, AG1, AG2) of the support bracing (ZV) and the flat material (F) of the tension bracing (ZA). For this purpose consideration is to be given preferably to dimensionally stable grating, in particular a section of a structural steel or geo-grating or a suitable perforated plate.

In the example shown in FIG. 1 provision is made for the connection between tension bracing and front element such that the frontal area of the flat material extends over the lower edge of the front element (FG) and this lower edge has projections which extend through the flat material (F) and transmit the tensile forces of the flat material. In particular it has been found to be advantageous in this instance for the front elements (FG) of at least two stacked cells (Z) to be mounted so that their upper and lower edges overlap. The configuration is such that projecting lattice rod ends of every upper latticed front element grip the rear area of the front element mounted below the former in the area of its upper edge and penetrate any flat material (F) present there.

Figure 2:
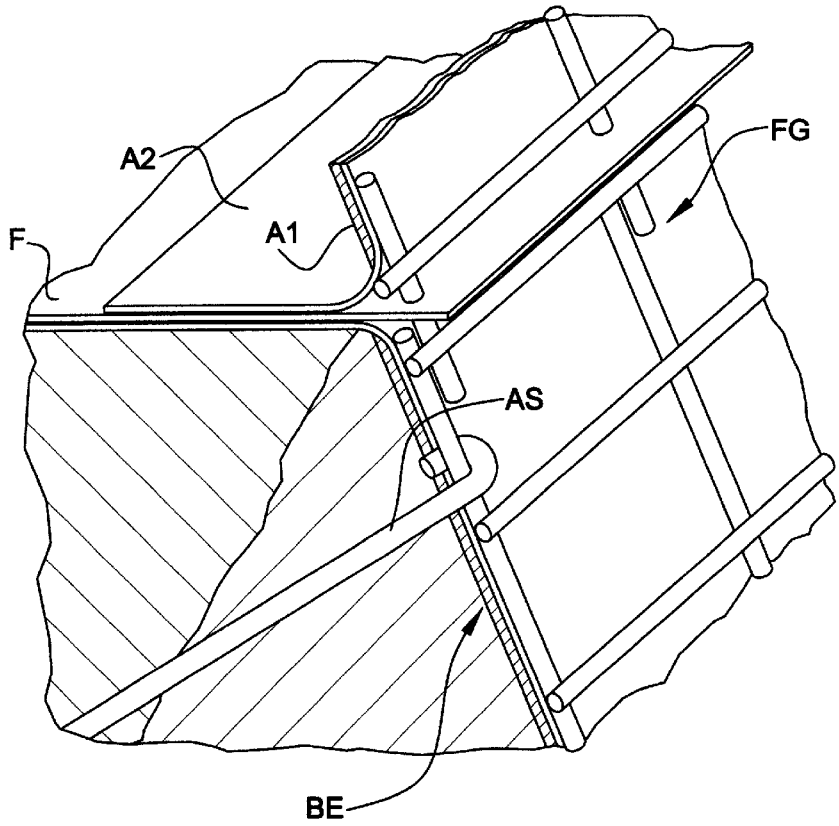
FIG. 2 shows an enlarged view of one part of FIG. 1.
Figure 3:
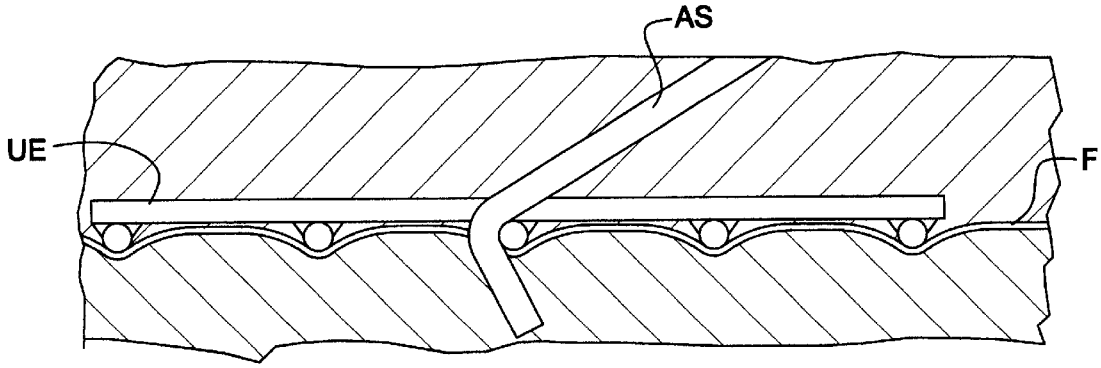
FIG. 3 shows an enlarged view of another part of FIG. 1.

FIGS. 2 and 3 present an enlargement of the structural details of the preceding example.

Figure 4:
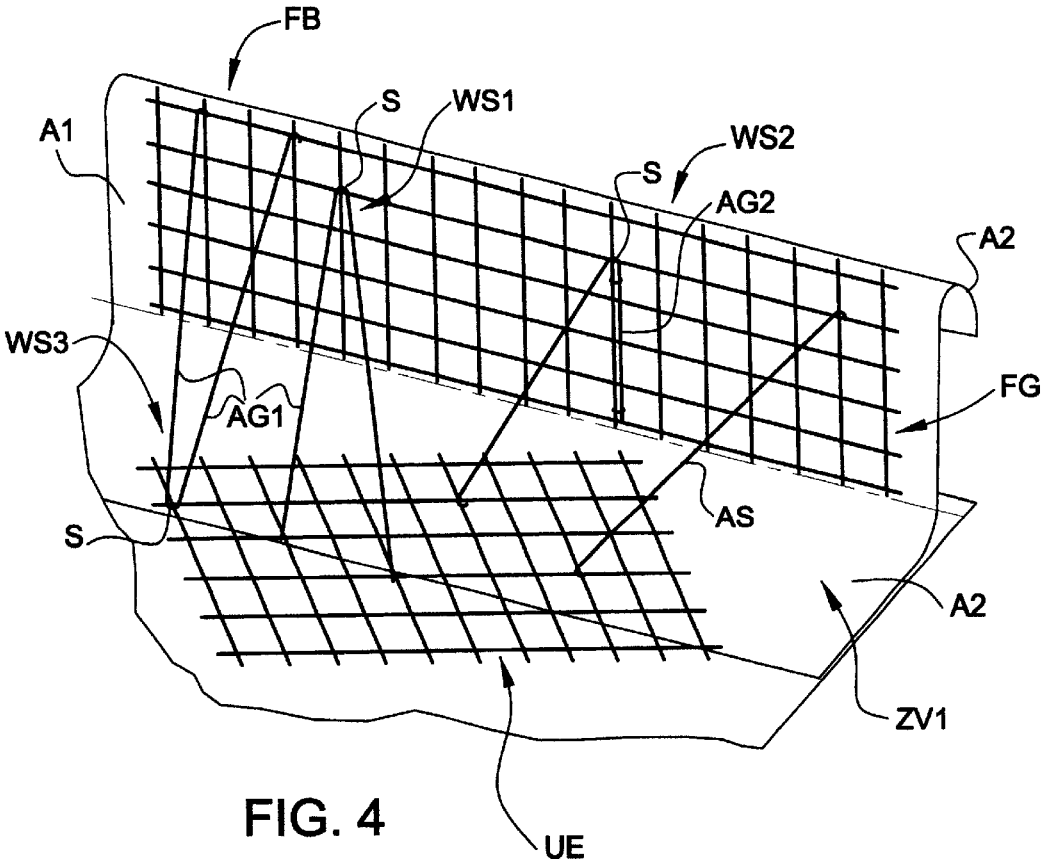
FIG. 4 shows a perspective view of a top stage of a cellular structure.

FIG. 4 shows a perspective view of the top stage of a cellular structure of the type described in the foregoing when completed, in the form of a rear view of an elongated front element FG with adjoining cell bottom. The following essential features of the development of the invention are to be noted:

Each front element (FG) has associated with it a plurality of rod-shaped support bracing elements which are connected only to the flat material (F) of the tension bracing (ZA) and the front element (FG), at different elevation and/or azimuth angles relative to the base plane of the cell or the frontal plane of the wall. A configuration of the support bracing elements differing from the backfill of the wall to the front of the wall has proved to be advantageous in many instances. A significant development of the support bracing (ZV1) illustrated here comprises a plurality of rod-shaped or angular bracing elements with a common transmission element (UE). This contributes both to optimum stability and to cost reduction. A latticed transmission element (UE) with more or less square or rectangular lattice openings to which the rod-shaped support bracing elements in the corner area of a grating opening are connected is also provided.

The example also illustrates as an essential feature a support bracing with a multiple-arm angle brace (WS1) which consists of two rod-shaped brace elements AG1 positioned at an angle to each other and connected to the front element (FG) of connected brace elements AG1 in the area of the point (S) of an angle. These brace elements are connected in the area of their free ends only to the flat material (F) of the tension bracing (ZA). Also present is a multiple-arm angle brace (WS2) which consists of two rod-shaped brace elements mounted at an angle to each other and connected to a front element (FG) in the area of the point (S) of the angle, of which a first brace element (AG1) is connected in the area of its free end only to the flat material (F) of the tension bracing (ZA), opposite which a second brace element (AG2) extends along the front element. There is another alternative, a multiple-arm angle brace (WS3), again with two rod-shaped brace elements (AG1) mounted at an angle to each other and connected in the area of the point (S) of the angle to the flat material (F) of the tension bracing (ZA), which elements (AG1) are connected on the other side to the front element (FG) a certain distance from the bottom edge of the latter, especially in the central to upper area of the front element elevation. These embodiments permit optimization of various aspects of the bracing effect, at significantly low cost. In particular, use may be made optionally of trestles for the front elements in assembly, ones which have at least three rod elements connected to each other preferably in one piece, in the form of a three-dimensional tripod or multiped.

Figure 5:
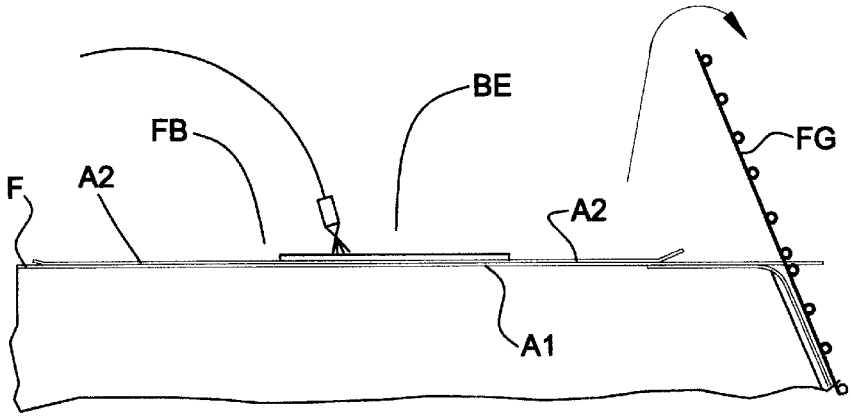

In order to rationalize manufacture of the structures it may be important to introduce greenery elements (BE) for the front of the cellular structure, ones prepared in advance outside the construction site or also in situ. An element such as this, as illustrated in FIG. 2 and shown in detail in FIG. 5, comprises flexible and liquid-permeable flat greenery material (FB) with at least one first section (A1) adapted to the front elevation of a structural cell (Z), with plant seeds and optionally with plant growth promotion means, and with at least one second section (A2) adjoining or overlapping the first and connected to it by static friction or adhesion, for shearing force transmission between stacked structural cells or for tensile force transmission to bracing elements and/or frontal structural elements. Such an element may be manufactured preferably by having the greenery section provided for installation on the inside of a front element—in the case of in-situ production on a road level—applied in the form of an easily flexible and liquid-permeable strip of flat material by scattering or spray application of seed, optionally followed by application of a powdered means for water retention and moistening. This is to be followed by application of a vegetation mat and securing of the latter by adhesion. It is claimed for the invention that it is especially advantageous to include extension of a greenery element to the front element in prefabrication, as is specified in claim 25.

An essential design concept of one alternative process for manufacture of a structure as claimed for the invention is represented by introducing support or bracing elements before introduction and compaction of the earth or rock filling on the inside of a front lattice element provided with flexible flat material and by suspending at least one hook or eye section on the front lattice element, the flat material being cut through. This results in especially efficient manufacture. In particular a manufacturing process as claimed for the invention may be designed, with reference to the illustration in FIG. 1, as follows:

(a) production of a foundation FU which extends below at least the front ground plan of the wall, as well as a subgrade extending rearward above the bracing depth provided, for construction of the lowest wall grade;

(b) application of a strip of flat tension bracing material to the subgrade and introduction and optionally also temporary fastening of a more or less level, dimensionally stable frontal lattice element the surface dimensions of which correspond to the stage height and the wall width or the width of an assigned wall section, in upright position and with its bottom edge in a position corresponding to that of the front of the wall;

(c) spreading out and positioning and optionally fastening of the front part of the strip of flat tension bracing material on the front element and optionally pulling the front edge of the flat material over the bottom edge of the front element;

(d) installation of support braces or support trestles between the front part of the section of flat material spread out on the bottom of the cell on one side and the inside of the front element covered with flat material on the other, optionally accompanied by local perforation of the flat material and more precise alignment of the front element so that definitive mounting support of the latter is ensured;

(e) preparation of a new subgrade by filling the structural cell with earth, rock, or bulk material and compaction up to the upper edge of the front element, and then preparation of the next structural cell on top by following process steps (b) to (d), the lower edge of the new front element, after being positioned on the upper edge of the front element below it, then being rammed into the filler, especially behind this upper edge.

Other alternative embodiments of the invention, which may be created especially in addition to or in conjunction with other features of the invention, are explained in what follows with reference to FIGS. 6 to 13.

Figure 6:
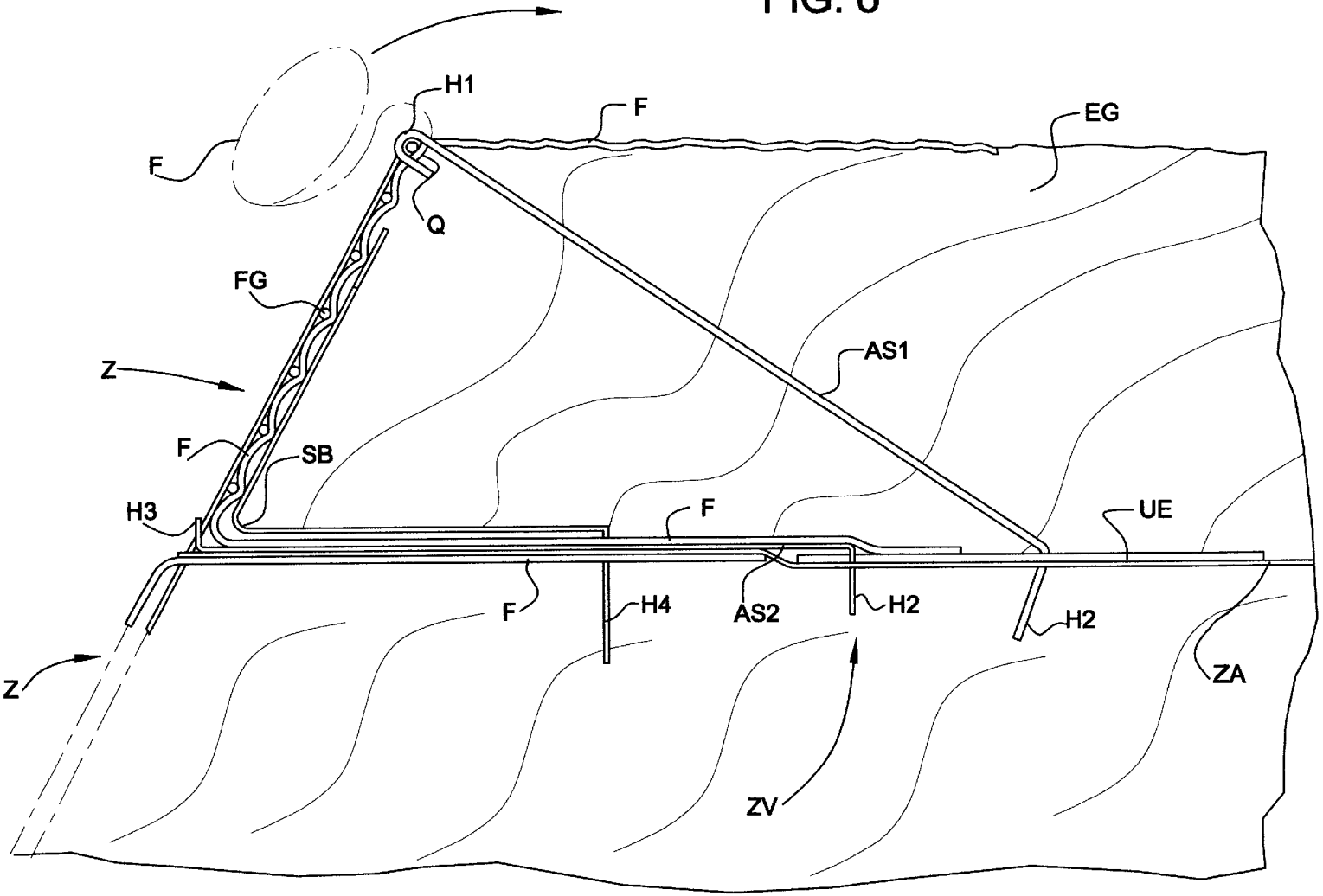
FIG. 6 shows a structure with stack cells.

FIG. 6 shows a structure with stacked cells Z which contain a earth or rock filling EG and a cladding of flexible, liquid-permeable, and corrosion-resistant flat material F. Inside a bare outer surface inclined toward the horizontal the cells Z are provided with a dimensionally stable front grating element FG in the form of a separate component extending at least approximately in one plane only. The front grating elements are also provided with tension bracings ZV in a predetermined frontal inclination and front position; these bracings are fastened on one side to the front grating elements and on the other in flexible tension bracings ZA extending into the earth or rock filling EG. Every tension bracing comprises at least one first connecting strut AS1 fastened in the area of the upper edge of the particular front grating element and/or at least one second connecting strut AS2, which is connected in the area of the lower edge of the front grating element to at least one tension bracing ZA extending into the earth or stone filling. Simple means are thus used to obtain reliable retention of the front element against both foundation pressure acting more or less horizontally, tilting moments resulting from forces acting irregularly and alternating during filling compaction, and traffic loads. After the structure has been installed for some time such loads may be increasingly taken over by roots penetrating the forward area of the cells.

Figure 7:
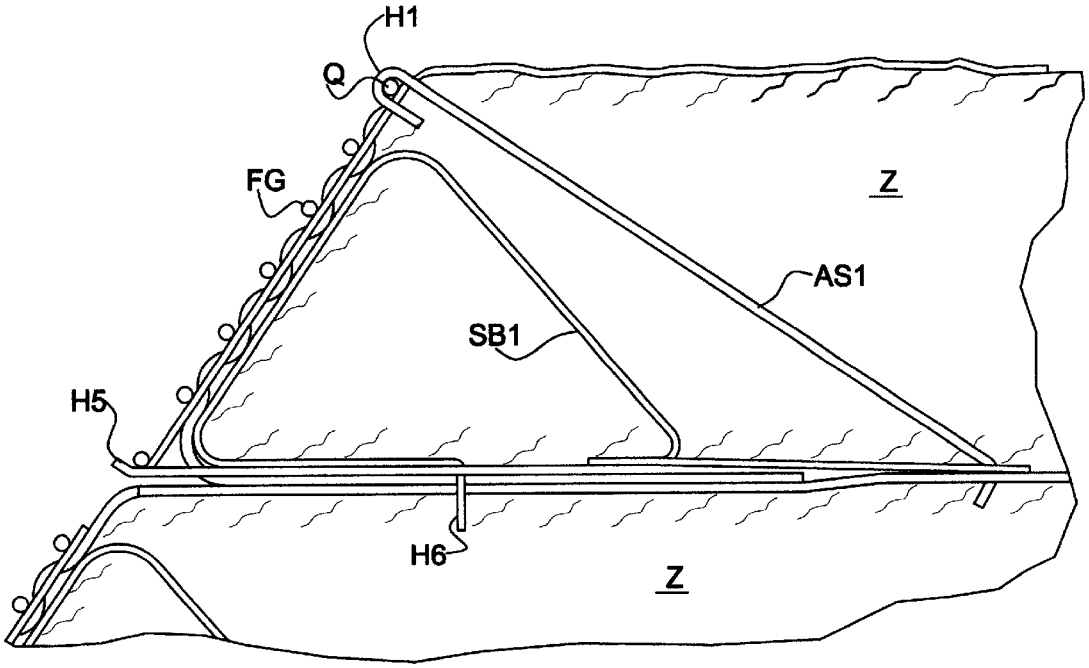
FIG. 7 shows a trestle SB1 in the form of a triangular rod structure.

As the examples in FIGS. 6 and 7 show, two strut or bracing elements AS1, AS2, mounted at an angle to each other are provided in order to achieve highly stable, statically definite support. Optionally the tension bracings may advantageously be mounted by attachment directly on the front grating element, even independently of strut elements. In addition, it may be advantageous to mount two strut or bracing elements positioned at an angle to each other at least approximately in a vertical plane.

As is also to be seen from FIG. 6, the upper strut or brace element AS1 is suspended by positive locking on a cross rod Q of the front grating element by a hook or eye section H1, which in particular may also be d-shaped. On the other side the element AS1 is suspended by force fitting on a brace ZA extending into the earth or stone filling, with a section H2 also hook shaped, in this instance simply bent at an angle. The same applies to the rear angular section H2 of the lower element AS2, while a front hooked section H3 of the latter extends around the lower edge of the front grating element and thus supports the latter against foundation forces. FIG. 6 also shows an angular trestle SB inserted behind the front grating element FG to support the latter during assembly. A section H4 of the trestle SB bent downward at an angle and extending into the cell Z positioned below it secures the latter against displacement during compaction.

As a variation of FIG. 6, FIG. 7 shows a trestle SB1 in the form of a triangular rod structure mounted behind the front grating element FG. In this case as well the trestle performs the function of strut or bracing element with a front hooked section H5 for support of the lower edge of the front grating element and with a rear hooked section H6 functioning as load bearing thrust bracing on the cell positioned below it.

Figure 8:
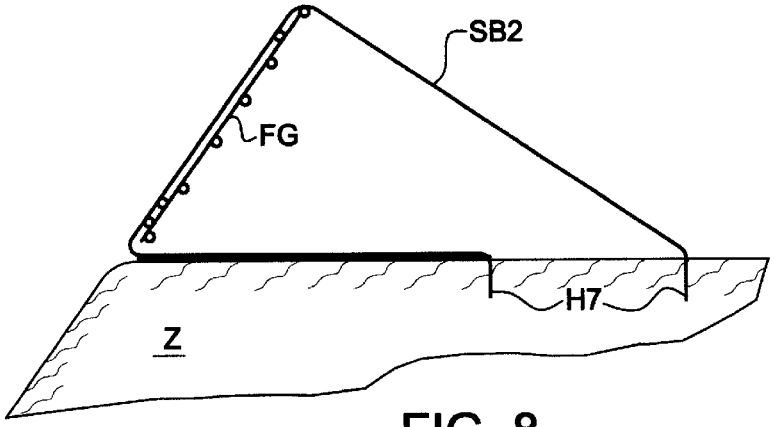
FIG. 8 shows a development of a trestle SB2.

FIG. 8 shows a development of a trestle SB2 which is provided for insertion of a front grating element FG and thus can provide positional stability for the front grating element. This front grating element is to be secured on the trestle prior to compaction, for example, by simply looping a wire around the trestle. Angular hooked section H7 functions as tensile and thrust bracing on the cell Z positioned below it.

Figure 9:
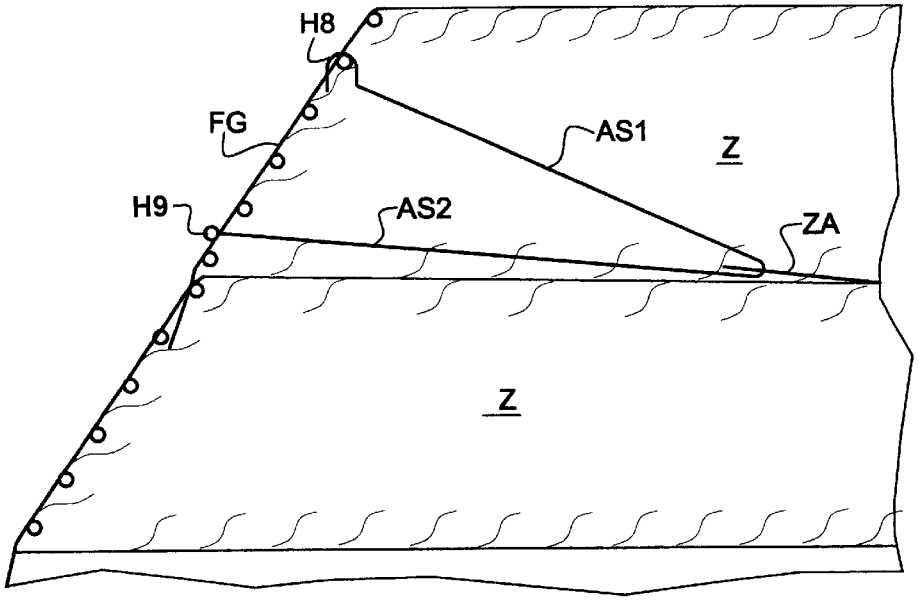
FIG. 9 shows bracing elements AS1, AS2 with two angular hook-shaped sections H8 and H9.
Figure 10:
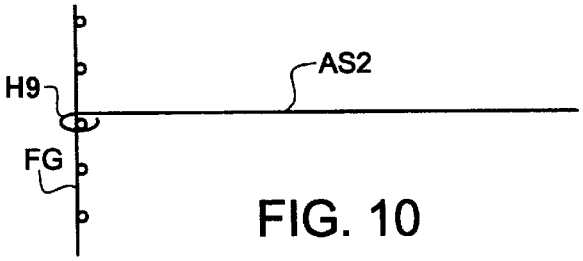
FIG. 10 shows a simplified top view of FIG. 9.

FIG. 9 and FIG. 10, the latter a simplified top view oriented at a right angle to FIG. 9, show strut or bracing elements AS1, AS2 with two angular hook-shaped or eye-shaped suspension sections H8, H9, bent at approximately a right angle to each other around a rod shaft. It is advantageous for these sections to be U-shaped or d-shaped. The upper section H8 is in the form of a U-clamp bent crosswise to the pertinent rod shaft and consequently can provide tensile and compressive forces for positive-locking retention of the front grating element. Because of its U-shape indicated in FIG. 9, extending in a plane at a right angle corresponding to the frontal plane, the lower U-section H9 can fit around a vertical rod section of the front grating element; this affords advantages in assembly.

Figure 11:
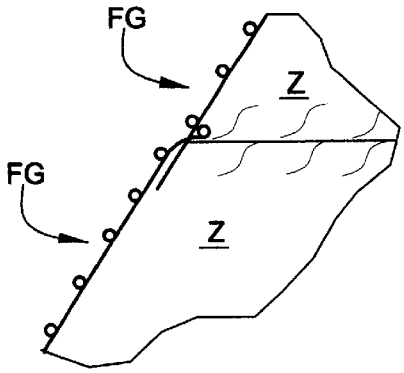
FIGS. 11 and 12 show the front grating elements FG, with overlapping upper and lower edges of two stacked cells Z.
Figure 12:
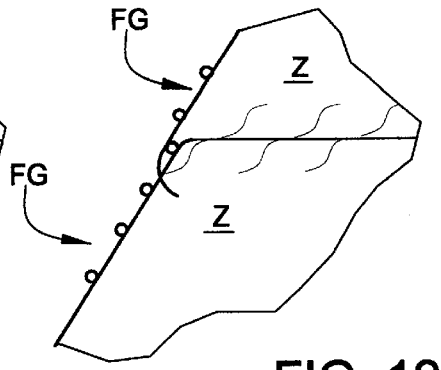

FIGS. 11 and 12 show the front grating elements FG, with overlapping upper and lower edges, of two stacked cells Z. Additional horizontal stability is thereby obtained by especially simple means. The upper front grating element is preferably provided with projecting lattice rod ends which extend behind the front grating element in the area of the upper edge of the latter. Optionally the projecting rod ends extend through the flexible flat material present here. These front grating elements may also have a curved or angular section in the area of their upper and/or lower edge projecting preferably into an adjacent cell.

Figure 13:
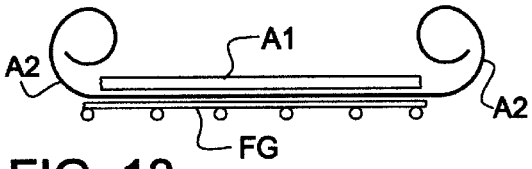
FIG. 13 shows a prefabricated, liquid-permeable and flexible, flat material element for the front of a cellular structure.

FIG. 13 illustrates a prefabricated, liquid- permeable and flexible, flat material element for the front of a cellular structure with earth or rock filling plantable with greenery, one which may be used to advantage for structures of this type as claimed for the invention, and optionally also for plantable structures of other types. There is shown here a first section A1 adapted to the front elevation of a structural cell Z provided with plant seeds and optionally with plant growth promotion means and at least one section section A2 adjoining the first section, for transmission of thrust or tensile forces between stacked structural cells or bracing elements. An element such as this permits especially efficient operations in fabrication of a cellular structure.

What is claimed is:

1. A cell structure, for use in a cellular structure comprising layers of cells, in particular a supporting or sound insulation structure, filled with earth, rocks, or bulk material, comprising:

a tension bracing comprising at least a flat, flexible, liquid-permeable, and corrosion-resistant material bounding said cell and extending into the interior of said cell, at least one dimensionally stable front element connected to said tension bracing, and a support bracing comprising at least on bracing element connected to said at least one front element and extending into the interior of said cell.

2. The cell structure according to claim 1, wherein at least one said bracing element connects to said tension bracing within said cell by one of frictional connection or positive locking.

3. The cell structure according to claim 1, wherein said at least one brace element is rod-shaped with connection means for connecting to at least one of said front element or said tension bracing.

4. The cell structure according to claim 3, wherein each one of said at least one front element has a plurality of rod-shaped bracing elements connected only to said front element and said tension bracing.

5. The cell structure according to claim 4, wherein said plurality of rod-shaped bracing elements are positioned at various angles and azimuths with respect to said front element.

6. The cell structure according to claim 5, wherein said plurality of rod-shaped bracing elements diverge in direction from said tension bracing to said front element.

7. The cell structure according to claim 3, wherein said rod-shaped bracing element has one of a hook or an eye section connected by positive locking to said front element.

8. The cell structure according to claim 7, wherein said rod-shaped bracing element has one of a hook or an eye section at each end of the rod for connection to said front element and said tension bracing.

9. The cell structure according to claim 8, wherein said rod-shaped bracing element is bent into a right angle.

10. The cell structure according to claim 1, wherein said at least one brace element comprises at least two rod-shaped components positioned at an angle to each other, connected proximate to each other on said front element, and connected to said tension bracing.

11. The cell structure according to claim 1, wherein said at least one brace element comprises at least two rod-shaped components positioned at an angle to each other and connected proximate to each other on said front element, of which one rod-shaped component is connected to said tension bracing and the other rod-shaped component extends along said front element.

12. The cell structure according to claim 1, wherein said at least one brace element comprises at least two rod-shaped components positioned at an angle to each other, connected proximate to each other on said tension bracing, and connected to said front element.

13. The cell structure according to claim 1, wherein at least one transmission element abuts said tension bracing to allow for positive locking between said support bracing and said tension bracing.

14. The cell structure according to claim 13, wherein said at least one transmission element is a dimensionally stable latticework.

15. The cell structure according to claim 13, wherein each one of said at least one transmission element is operable with a plurality of bracing elements.

16. The cell structure according to claim 13, wherein said at least one transmission element has a rectangular grating structure, and said support bracing connects to said at least one transmission element at a corner of a rectangular grating opening of said rectangular grating structure.

17. The cell structure according to claim 1, wherein said support bracing comprises at least one bracing element connected proximate an upper edge of said front element and at least on bracing element connected proximate a lower edge of said front element.

18. The cell structure according to claim 1, further comprising a prefabricated greenery element covering a front surface of said cell, wherein said prefabricated greenery element comprises a first section covering said front element and a second section overlapping a portion of said first section and said tension bracing.

19. The cell structure according to claim 1, wherein said front element comprises a prefabricated greenery element in the interior of said cell which comprises a first section covering an inside surface of a front surface of said cell and a second section overlapping a portion of said first section and said tension bracing.

20. A cell structure, for use in a cellular structure comprising layers of cells, in particular a supporting or sound insulation structure, filled with earth, rocks, or bulk material, comprising:

a tension bracing comprising at least a flat, flexible, liquid-permeable, and corrosion-resistant material bounding a bottom surface of said cell, at least one dimensionally stable front element connected to said tension bracing by positive locking, and a support bracing comprising at least one bracing element connected to said at least one front element and extending into the interior of said cell.

21. The cell structure according to claim 20, wherein said tension bracing extends beyond said connection to said front element and said front element has projections extending through said tension bracing.

22. The cell structure according to claim 21, wherein said projections connect with a front element of an adjacent cell located below said cell.

23. The cell structure according to claim 20, wherein said front element of said cell overlaps a front element of an adjacent cell located below said cell.

24. The cell structure according to claim 20, wherein said front element has curved projections on at least one of an upper edge or lower edge projecting into the interior of an adjacent cell.

25. The cell structure according to claim 20, wherein at least one of said at least one bracing element comprises at least three rod-shaped components, connected together to form a tripod.

26. A method to manufacture a cell for a cellular structure comprising layers of cells, in particular a supporting or sound insulation structure, filled with earth, rocks, or bulk material, including:

producing a foundation extending below a location for a cell, applying a flat, flexible, liquid-permeable, and corrosion-resistant material to said foundation, placing a dimensionally stable front element in an upright position in a location corresponding to a front of said cell, connecting said tension bracing and said front element, installing support braces between said tension bracing and said front element, filling and compacting said cell with earth, rock, or bulk material to a level corresponding to an upper edge of said front element, repeating steps for subsequent cells above said cell.

27. The method according to claim 26, including placing a lower edge of said front element behind an upper edge of a front element of a cell located below said cell.

28. The method according to claim 26, including using a prefabricated greenery element as said front element.

29. The method according to claim 26, including:

placing a flexible and liquid-permeable material on said front element, applying seed to said flexible and liquid-permeable material, applying a powdered means for water retention and moistening to said flexible and liquid-permeable material, applying a vegetation mat over said flexible and liquid-permeable material, and securing said vegetation mat to said front element.

* * * * *